US006931742B1

(12) United States Patent
VanWinkle

(10) Patent No.: US 6,931,742 B1
(45) Date of Patent: Aug. 23, 2005

(54) MOTORIZED CHALK LINE APPARATUS

(76) Inventor: Michael VanWinkle, 152 Devonia Ave., Lexington, KY (US) 40505

( * ) Notice: Subject to any disclaimer, the term of this patent is extended or adjusted under 35 U.S.C. 154(b) by 46 days.

(21) Appl. No.: 10/666,201

(22) Filed: Sep. 18, 2003

(51) Int. Cl.[7] ..... B44D 3/38

(52) U.S. Cl. ..... 33/414; 242/390.8; 242/596; 33/761

(58) Field of Search ..... 33/414, 413, 756, 33/761, 762, 763, 755, 759, 760, 769; 242/390.8, 242/596, 596.8, 588.6

(56) References Cited

U.S. PATENT DOCUMENTS

| | | | | | |
|---|---|---|---|---|---|
| 680,557 | A | * | 8/1901 | Wilson | 33/414 |
| 1,588,577 | A | * | 6/1926 | Heifler | 242/588 |
| 3,438,595 | A | * | 4/1969 | West et al. | 242/394 |
| 3,888,010 | A | * | 6/1975 | Hyde et al. | 33/414 |
| 4,189,107 | A | | 2/1980 | Quenot et al. | |
| 4,192,078 | A | | 3/1980 | Lore et al. | |
| 4,197,656 | A | * | 4/1980 | Lane et al. | 33/414 |
| 4,565,011 | A | | 1/1986 | Karger | |
| 4,592,148 | A | | 6/1986 | Longenette | |
| 4,660,291 | A | * | 4/1987 | Dehn | 33/414 |
| 4,765,557 | A | | 8/1988 | Kahmann | |
| 4,773,162 | A | | 9/1988 | Lin | |
| 4,813,145 | A | | 3/1989 | Josey, Jr. et al. | |
| D314,156 | S | | 1/1991 | Doyle | |
| 5,042,159 | A | | 8/1991 | Millen | |
| 5,212,875 | A | | 5/1993 | Corso | |
| D345,513 | S | | 3/1994 | Syrett | |
| 5,444,919 | A | | 8/1995 | Alves | |
| 5,465,494 | A | * | 11/1995 | Johnston | 33/414 |
| 5,509,616 | A | * | 4/1996 | Millen et al. | 242/381.5 |
| 5,743,021 | A | * | 4/1998 | Corcoran | 33/762 |
| 5,822,874 | A | * | 10/1998 | Nemes | 33/414 |
| 5,920,997 | A | * | 7/1999 | Girtman | 33/414 |
| 6,027,068 | A | * | 2/2000 | Lantsman | 242/564.4 |
| 6,167,635 | B1 | * | 1/2001 | Lin | 33/767 |
| 6,484,412 | B1 | | 11/2002 | Donaldson et al. | |
| 6,715,214 | B1 | * | 4/2004 | Lin | 33/755 |
| 6,718,649 | B1 | * | 4/2004 | Critelli et al. | 33/761 |

* cited by examiner

*Primary Examiner*—R. Alexander Smith
(74) *Attorney, Agent, or Firm*—Kenneth F. Pearce

(57) ABSTRACT

Chalk line devices are commonly used in the building and/or construction arts. The motorized chalk line apparatus is particularly useful for automatically reeling in a chalk line wound about a spool that is journaled by a pair of stub axles. A battery powered drive automatically winds the chalk line about the spool. In use, the chalk line is manually pulled away from the apparatus to create the marking, but when the user actuates the switch, the spool automatically rewinds the chalk line.

12 Claims, 9 Drawing Sheets

MOTORIZED CHALK LINE APPARATUS

BACKGROUND OF THE INVENTION

1. Field of the Invention

The present invention relates to chalk line devices typically used to generate various markings at construction sites. These devices have practical applications in the building industry and the corresponding trades associated therewith. In particular, the present invention is directed to motorized chalk line devices and methods of using the chalk line devices.

In accordance with the present invention, a spool having a wind of chalk line thereabout rotates on a pair of stub axles positioned in the spool compartment. A gearing mechanism is positioned about the spool or reel. And a chalk reservoir is located in proximity to the spool compartment. In select embodiments, after the chalk line has been extended from the device, the battery powered gearing mechanism drives the spool to reel in the chalk line. In operation, when the chalk line is pulled through the chalk reservoir, it carries chalk until the chalk line is snapped; thereafter, gravity pulls the loose chalk downward and onto the surface below the chalk line.

2. Description of the Previous Art a) U.S. Pat. No. 5,444,919-Alves teaches a housing (12), drive shaft (14), spindle (16), chalk line (18), chamber (20), driven gear (22), drive gear (24), plug (26), batteries (28) and handle (30). The '919 patent mandates through drive shaft (14) to be extended across the length of the chamber (20), as well as being mounted for rotation about its axis. Alves mounts his spindle (16) about the drive shaft (14) such that drive shaft (14) extends the entire length of the spindle (16).

b) U.S. Pat. No. 4,773,162-Lin enables a small motor (2) transmitting through the gear set (21) to a thread wheel (3), wherein the diameter of the thread wheel (3) is slightly bigger than the width of the box body (1). On the thread wheel (3) is the thread (31) which passes through the ink container (11) at the front of the box body (1). On the flange of the outer cover (12) of the ink body is a compartment to accommodate UM3 battery (4). As enabled in FIG. 1, the '162 patent's thread wheel (3) rotates about a through axle (unnumbered).

c) U.S. Pat. No. 5,212,875-Corso teaches that the housing (100) has a compartment for the motor (102) powered by a pair of conventional batteries (104). Corso's complex gearing mechanism, includes a shaft (106) which terminates in a gear (108) which engages with and drives disc gear (110) axially connected to gear (112) for driving gear (114) mounted to splined shaft (116). The '875 splined shaft (116) is adjustable to engage the appropriate one of three disclosed drums (24, 26, and 28).

d) U.S. Pat. No. 4,189,107-Quenot, et. al., among other things, teaches a gear reduction mechanism between the electric motor and the spool carrying the measuring tape.

e) U.S. Pat. No. 4,192,078-Lore, et. al., enables a helical spring (36) for automatically returning the chalk or plumb line to the housing.

f) U.S. Pat. No. 4,813,145-Josey, Jr., et. al., discloses a coiled spring attached to the spool for automatically retracting the chalk line.

g) U.S. Design Pat. No. 348,513-Syrett shows ornamental features of a chalk line reel.

h) U.S. Design Pat. No. 314,156-Doyle shows the ornamental features of a chalk line reel.

i) U.S. Pat. No. 6,484,412 B1-Donaldson, et. al. enables a measured refill chalk cartridge (12) in combination with a manually operated chalk line.

j) U.S. Pat. No. 5,042,159-Millen teaches the use a spiral band spring (26) for automatically retracting the chalk line into the casing (12).

k) U.S. Pat. No. 4,765,557-Kahmann utilizes a spiral spring (31) mechanism to automatically retract the chalk line.

l) U.S. Pat. No. 4,592,148-Longenette enables a spiral spring (29) and clutching mechanism (27) for automatically reeling in the chalk line.

m) U.S. Pat. No. 4,565,011-Karger discloses an automatic release for a spring mechanism that is be wound to its maximum capacity such that additional lengths of chalk line can be withdrawn without placing additional tension on the spring.

SUMMARY OF THE INVENTION

Unlike traditional chalk line devices, a hand crank is conspicuously absent from the present invention. Either a disposable or rechargeable battery powers the current motorized chalk line device. And furthering ease of use, the current invention can be provided with a contact switch, sensitive to the user's touch, which activates or deactivates the drive that rotates the spool to reel in or wind the chalk line.

The present invention also uniquely embodies a spool journaled by a pair of stub axles. Thus, the current apparatus meets the long felt but unfulfilled need of providing a functional and compact structure which eliminates the cumbersome necessity of designing a single through axle or shaft to span the entire breadth of the spool chamber. And in a similar vein, practice of the present invention eliminates the awkward necessity of using a splined shaft to engage a drum's key way to rotate the drum carrying the chalk line or chalk lines.

In operation, the user unwinds the chalk line from the spool by pulling the chalk line through the chalk reservoir. Before the chalk line exists the apparatus, while passing through the chalk reservoir, it is loaded with chalk or chalk powder. When the user pulls the chalk line away from the spool for a preselected distance and then snaps the chalk line to deposit the chalk on the surface below the chalk line, a marking for the user to follow is created.

An object of the present invention is to provide a motorized chalk line apparatus.

It is another object of the present invention to enable methods of using the motorized chalk line apparatus.

Still another object of the present invention, as compared to the traditional hand cranked chalk line devices, is to provide a motorized chalk line apparatus for quickly rewinding the chalk line.

Yet another object of the present invention is to incorporate a pair of stub axles into the spool compartment of the motorized chalk line apparatus.

It is yet another object of the present invention to provide a motorized chalk line apparatus having a chalk reservoir of sufficient dimension to reduce the frequency of refilling the chalk chamber.

Still another object of the present invention is to provide a motorized chalk line apparatus for carrying sufficient quantities of chalk or chalk power for preselected distances, i.e., until the chalk line is snapped by the user to deposit the chalk on the surface below the chalk line.

Yet still another object of the present invention is to reduce the strain of the user by elimination of the traditional hand cranks associated with chalk line devices.

Still another object of the present invention is to provide a motorized chalk line apparatus utilizing a rechargeable battery.

Yet another object of the present invention is to provide a recharging base in which the motorized chalk line apparatus can be placed when not in use.

An embodiment of the present invention can be described as a motorized chalk line apparatus comprising: a housing including an aperture; a spool compartment within the housing further having a first stub axle and a second stub axle; a chalk reservoir in proximity to the spool compartment; a spool including a winding of chalk line; a drive; a battery for powering the drive and a switch.

Another embodiment of the present invention can be described as a method of automatically reeling in a chalk line, comprising the steps of: attaching said chalk line to a spool; coupling the spool to a first and second stub axle within a spool compartment; gearing the spool to engage a drive; positioning a chalk reservoir proximate an outward opening of the spool compartment; supplying chalk to the chalk reservoir; linking a switch to a drive; engaging the switch battery power the drive to reel in the chalk line.

Still another embodiment of the present device can be described as a motorized chalk line apparatus comprising: a housing including an aperture; a spool compartment within the housing further having a first stub axle and a second stub axle; a chalk reservoir in proximity to the spool compartment; a spool including a winding of chalk line; a drive; a battery for powering the drive; a switch and a contact circuit for recharging the battery.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Although the disclosure hereof is detailed to enable those skilled in the art to practice the invention, the embodiments published herein merely exemplify the present invention.

Figure 1:
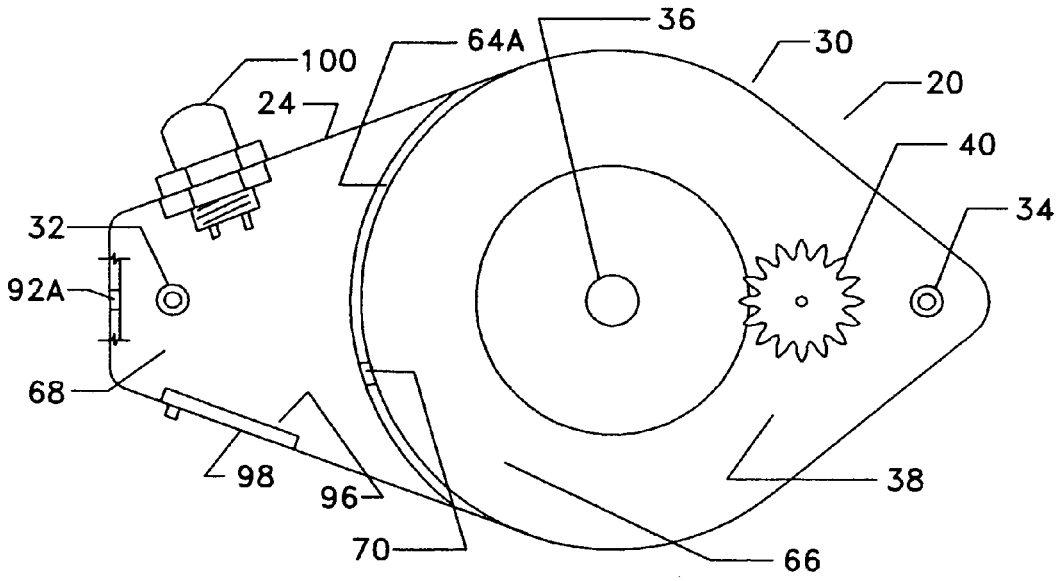
FIG. 1 depicts a laid open view of the inside of the first side of the present invention.
Figure 2:
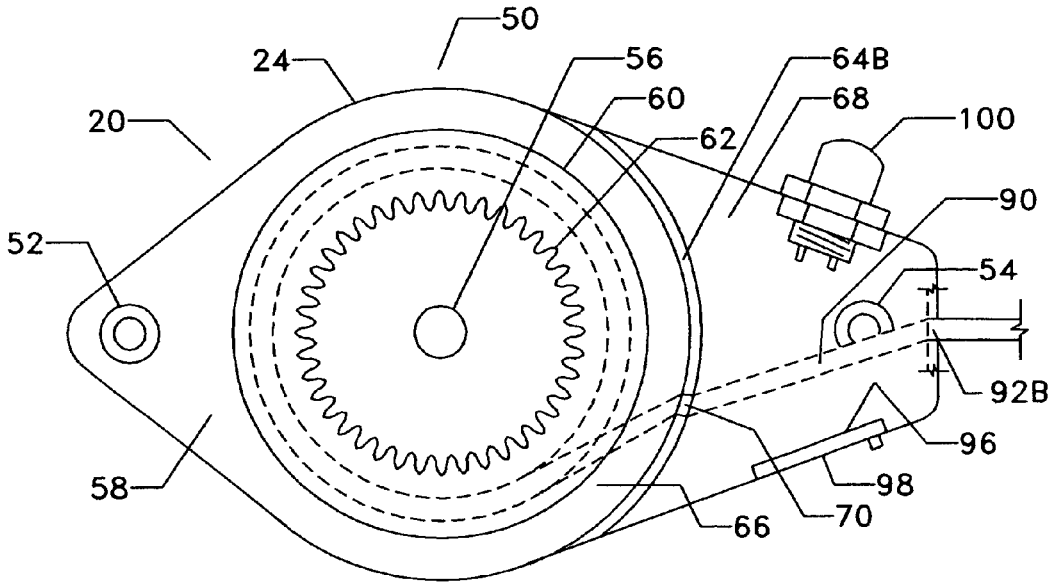
FIG. 2 depicts a laid open view of the inside of the second side of the present invention.

FIGS. 1 and 2 depict a laid open view of the inside of the first side (30) and the inside of the second side (50) of the motorized chalk line apparatus (20). First side (30) of housing (24) of motorized chalk line apparatus (20) has first receptacle (32) and second receptacle (34) for receiving the fasteners (shown in FIGS. 6 and 7) that hold first side (30) and second side (50) of motorized chalk line apparatus (20) together. Those skilled in the art recognize that more than two fasteners can be used to hold first side (30) and second side (50) together. First side (30) includes opening (92A) and second side (50) includes opening (92B). When first side (30) and second side (50) are fastened together, among other things, aperture (92) of housing (24) is created.

First stub axle (36) extends inward from inward side (38) of first side (30). Drive (40) also extends inward from inward side (38). Second side (50) is provided with first receptacle (52) and second receptacle (54) for receiving fasteners (not shown), such as screws, to hold first side (30) and second side (50) of motorized chalk line apparatus (20) together. Second stub axle (56) extends inward from the inward side (58) of second side (50).

When first side (30) and second side (50) of motorized chalk line apparatus (20) are joined together, spool (60) and its corresponding driven gear (62) are mounted on first stub axle (36) and second stub axle (56) via a spool hollow. Wall (64A), inward side (38) of first side (30) and wall (64B), inward side (58) of second side (50) create spool chamber (66) and chalk reservoir (68). When first side (30) and second side (50) are joined together wall (64A) and wall (64B) create wall (64) of spool chamber of spool chamber (66). Common opening (70) joins spool chamber (66) and chalk reservoir (68) which allows the chalk line (90) (shown in phantom) to unwind from spool (60). Contact switch (100) and slide (98) communicate with housing (24), and slide (98) is fitted to expose or close first opening (96) through which chalk can be added to chalk reservoir (68).

Figure 3:
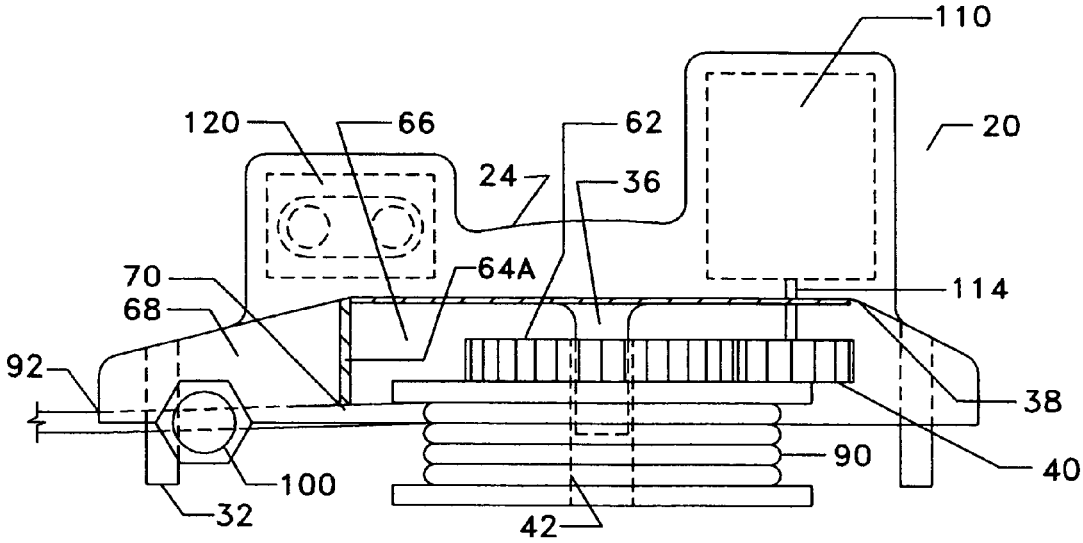
FIG. 3 is a lateral view of the first side of the present invention.

FIG. 3 is a lateral view of first side (30) of motorized chalk line apparatus (20). As shown, motor (110) and battery (120) communicate with housing (24). Although not shown in FIG. 3, contact switch (100), motor (110) and battery (120) are connected via the appropriate circuitry. Shaft (114) extends from motor (110) through inward side (38) of first side (30) and carries drive (40). As shown, drive (40) is a gear, but those skilled in the art recognize that other types of drives can be utilized to practice the present invention. In this view, spool (60) is coupled to stub axle (36).

Figure 9:
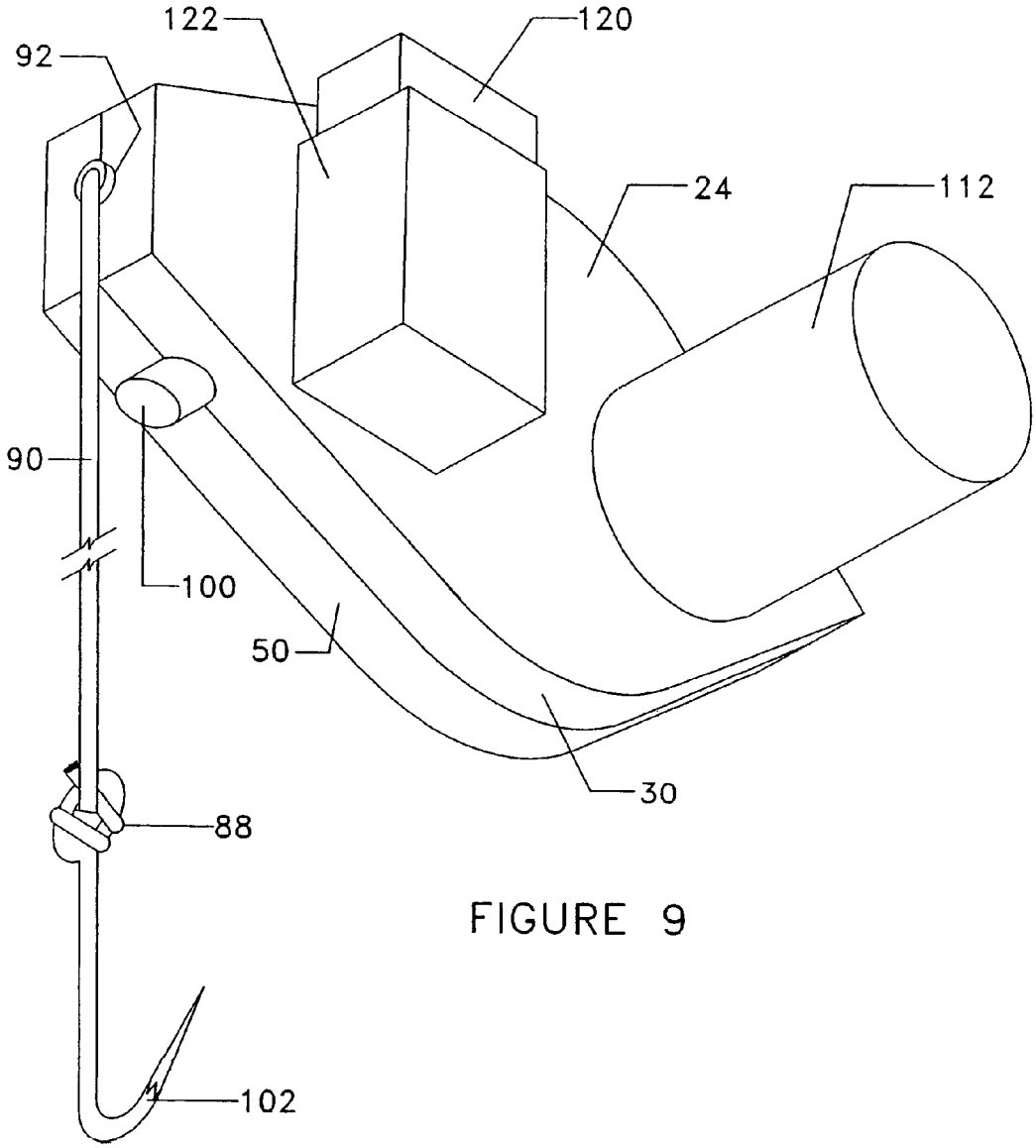
FIG. 9 is a pictorial representation of the present invention.

In operation, spool (60) rotates about stub axles (36 and 56), when the chalk line is pulled away from the spool or when drive (40) rotates driven gear (62) to cause the spool (60) to reel in the chalk line. Chalk line (90) is wound about spool (60) and has a section extending out of spool chamber (66) through common opening (70) of wall (64) into and through chalk reservoir (68) and out of aperture (92) of housing (24). As best shown in FIG. 9, chalk line (90) can be provided with stop (88) to prevent the tip of the chalk line from being wound about spool (60). In other embodiments, the chalk line can also include an anchor (102) which allows a single person to operate the present invention without the need of an assistant to hold the remote end of the chalk line.

Figure 4:
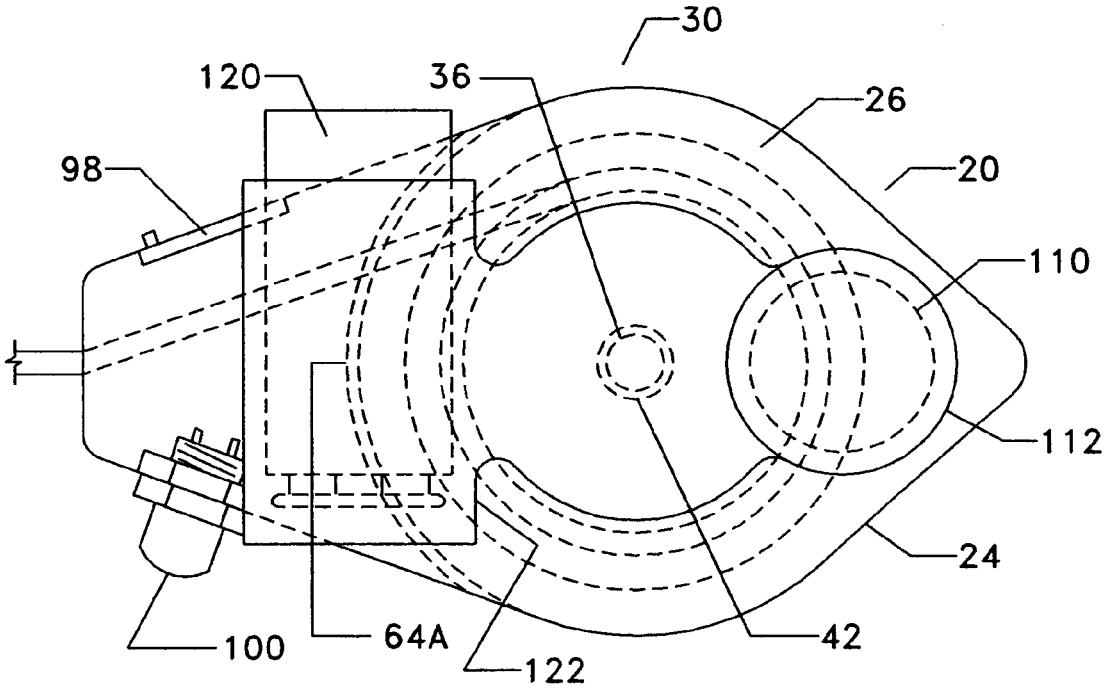
FIG. 4 is a view of the outward side of the first side of the present invention.

FIG. 4 is a view of the outward side of first side (30) of motorized chalk line apparatus (20). Housing (24) can be composed of plastic or other material capable of being constructed to accommodate motor (110) and battery (120). In select embodiments, the battery holder (122) and the motor chamber (112) can be joined to the outside surface (26) of housing (24) via any manner acceptable in the art while in other embodiments, housing (24) can be molded to internally include the motor chamber (112) and battery holder (122). As shown battery holder (122) of housing (24) does not include a cover for the battery (120), but in other embodiments, the battery holder can encase the battery. In this particular embodiment, motor chamber (112) of housing (24) is of a generally cylindrical-type design, but in accordance with the present invention, motor chambers be constructed in other ways.

Figure 5:
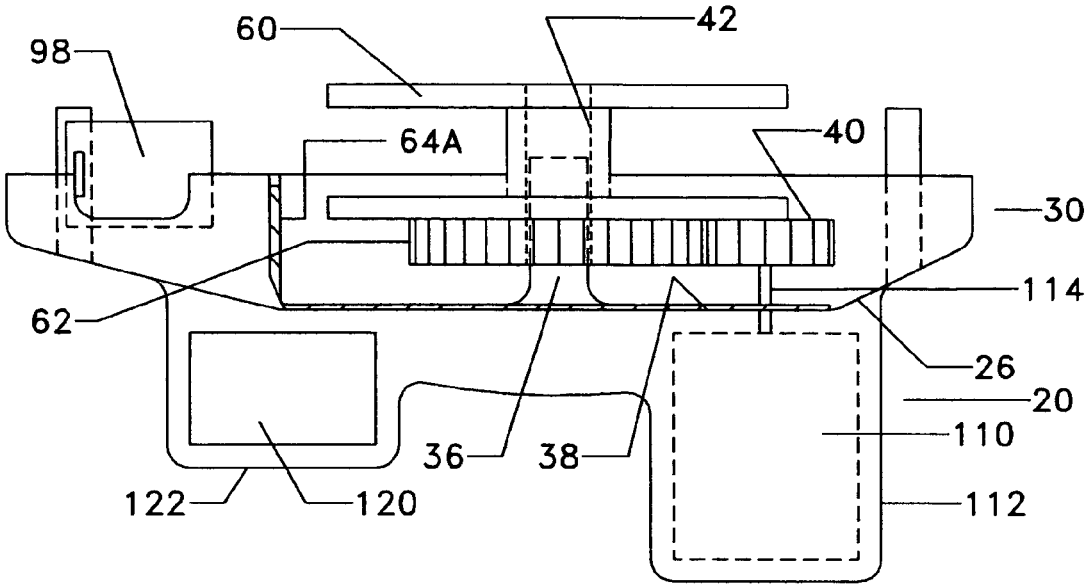
FIG. 5 is a lateral view of the first side of the present invention from the opposite perspective than shown in FIG. 3.

FIG. 5 is a lateral view of first side (30) of motorized chalk line apparatus (20) from the opposite perspective than the view shown in FIG. 3. As portrayed in FIG. 5, the chalk line (90) has been removed from the spool (60). Shaft (114) extends from motor (110) through inward side (38) of first side (30) and carries drive (40). Spool (60) rotates about stub axle (36), and driven gear (62) engages drive (40). Slide (98) is fitted to expose or close first opening (96).

Figure 6:
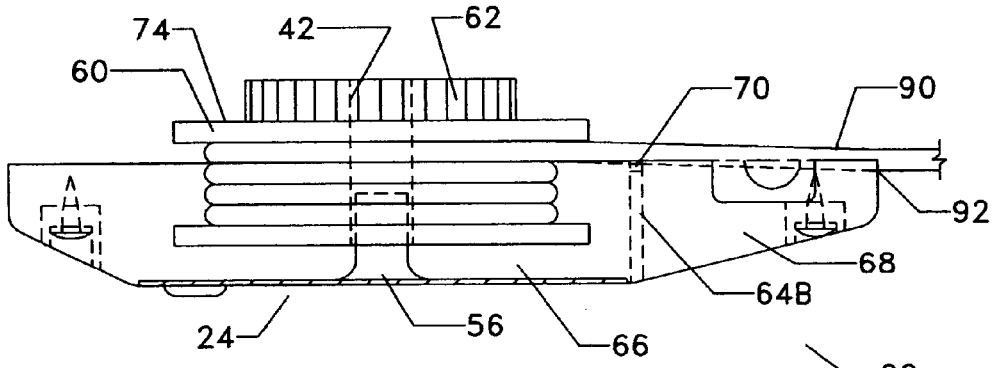
FIG. 6 is a lateral view of the second side of the present invention.

FIG. 6 is a lateral view of second side (50) of motorized chalk line apparatus (20). Spool (60) rotates about stub axle (56). Driven gear (62) is positioned about edge (74) of spool (60). Chalk line (90) is wound about spool (60) and a section of the chalk line is extended out of spool chamber (66) through common opening (70) of wall (64) into and through chalk reservoir (68) and out of aperture (92) of housing (24).

Figure 7:
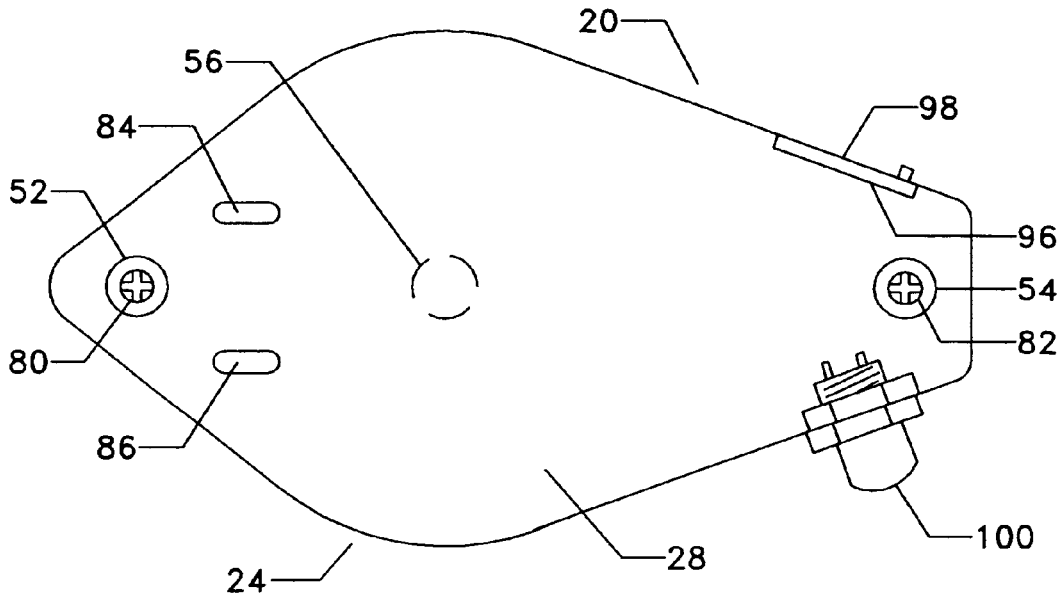
FIG. 7 is a view of the outward side of the second side of the present invention.

FIG. 7 is a view of the outward side (28) of second side (50) of motorized chalk line apparatus (20). First receptacle (52) receives fastener (80) and second receptacle (54) receives fastener (82). Outward surface (28) is provided with contacts (84 and 86) for reciprocating with a junction of the recharging base unit (not shown).

Figure 8:
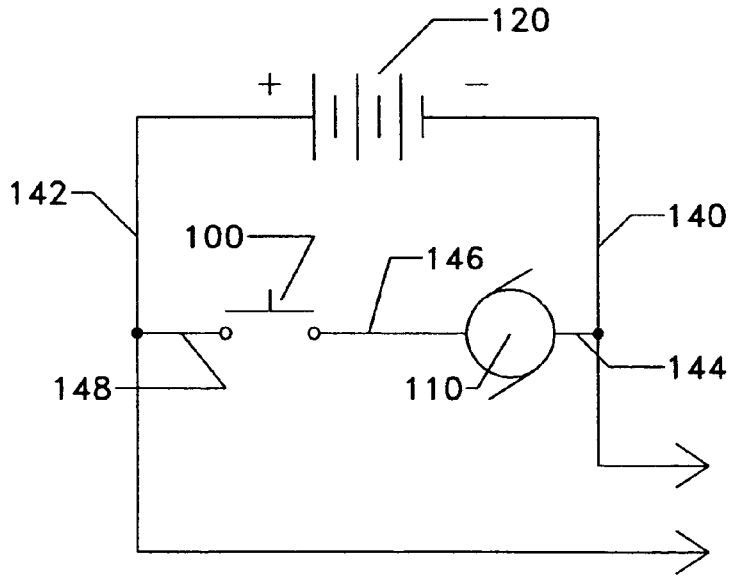
FIG. 8 is a schematic of the electric circuits of the present invention.

FIG. 8 is a schematic of the circuitry of the current motorized chalk line apparatus. Line (140) runs from contact (84) (not shown) to battery (120). Line (142) travels from battery (120) to contact (86) (not shown). Line (144) runs from line (140) to motor (110) while line (146) connects motor (110) to contact switch (100), and line (148) runs from contact switch (100) to line (142). It has been determined that a nine volt battery and its corresponding motor provide adequate power to rotate the spool to return the unwound chalk line. However, those skilled in the art recognize that other combinations of direct current devices for powering the spool are within the scope of the present invention.

FIG. 9 is a pictorial representation of the present invention. First side (30) and second side (50) are joined together to create housing (24) of motorized chalk line apparatus (20). Battery holder (122) for battery (120) and motor chamber (112) extend outwardly from first side (30). Contact switch (100) is exposed for ease of operation and a portion of chalk line (90) extends outwardly from aperture (92). In this specific embodiment, chalk line (90) includes stop (88) and anchor (102).

Figure 13:
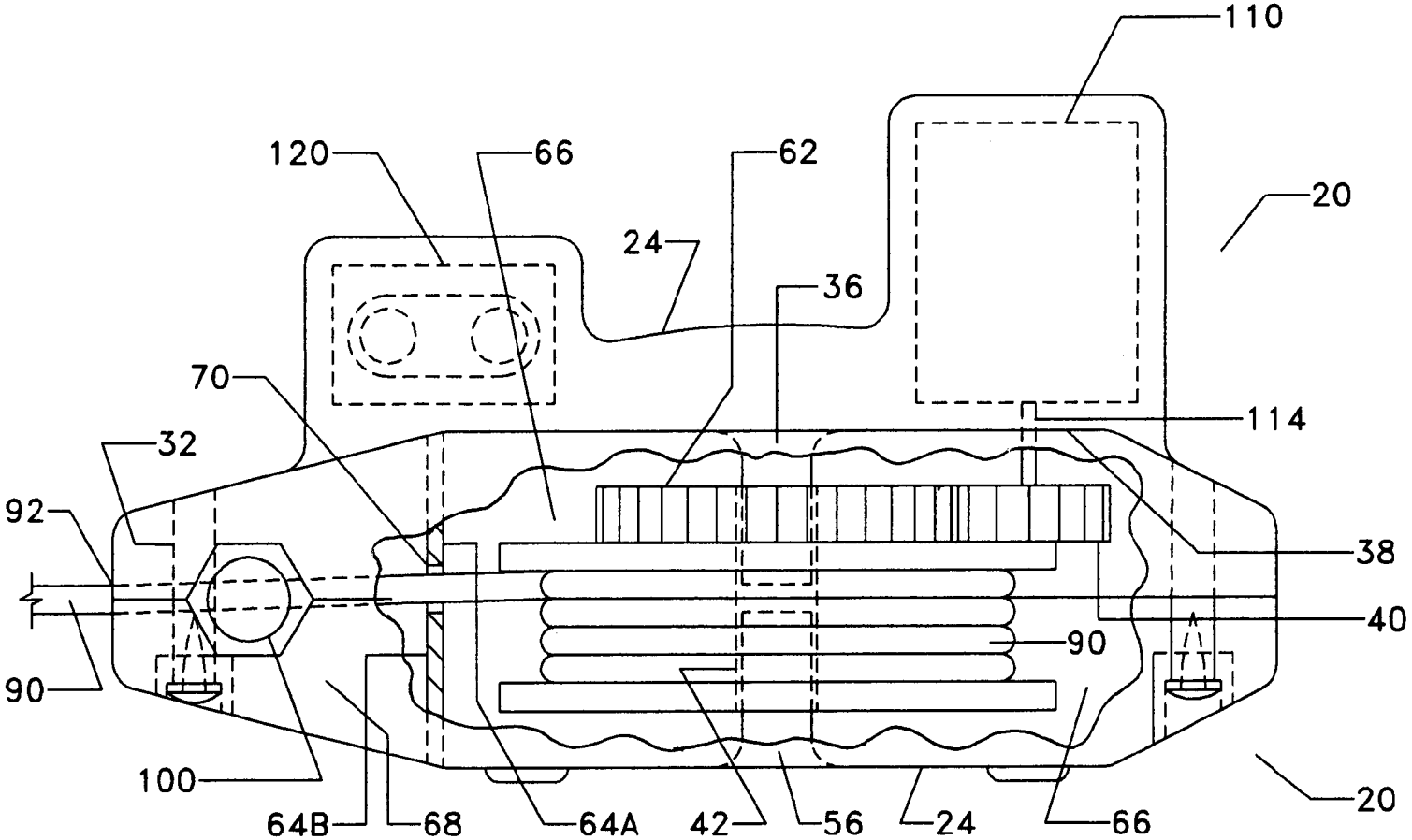
FIG. 13 is a combination of FIG. 5 and FIG. 6 that shows the first side of the present invention connected with the second side of the present invention.

FIG. 13 is a combination drawing of FIG. 5 and FIG. 6 that shows the first side of the present invention connected with the second side of the present invention. As shown, hollow (42) extends the width of spool (60) from stub axle (36) to stub axle (56). In the practice of the present invention, drive (40) engages driven gear (62) to cause spool (60) to rotate about stub axles (36 and 56).

Figure 10:
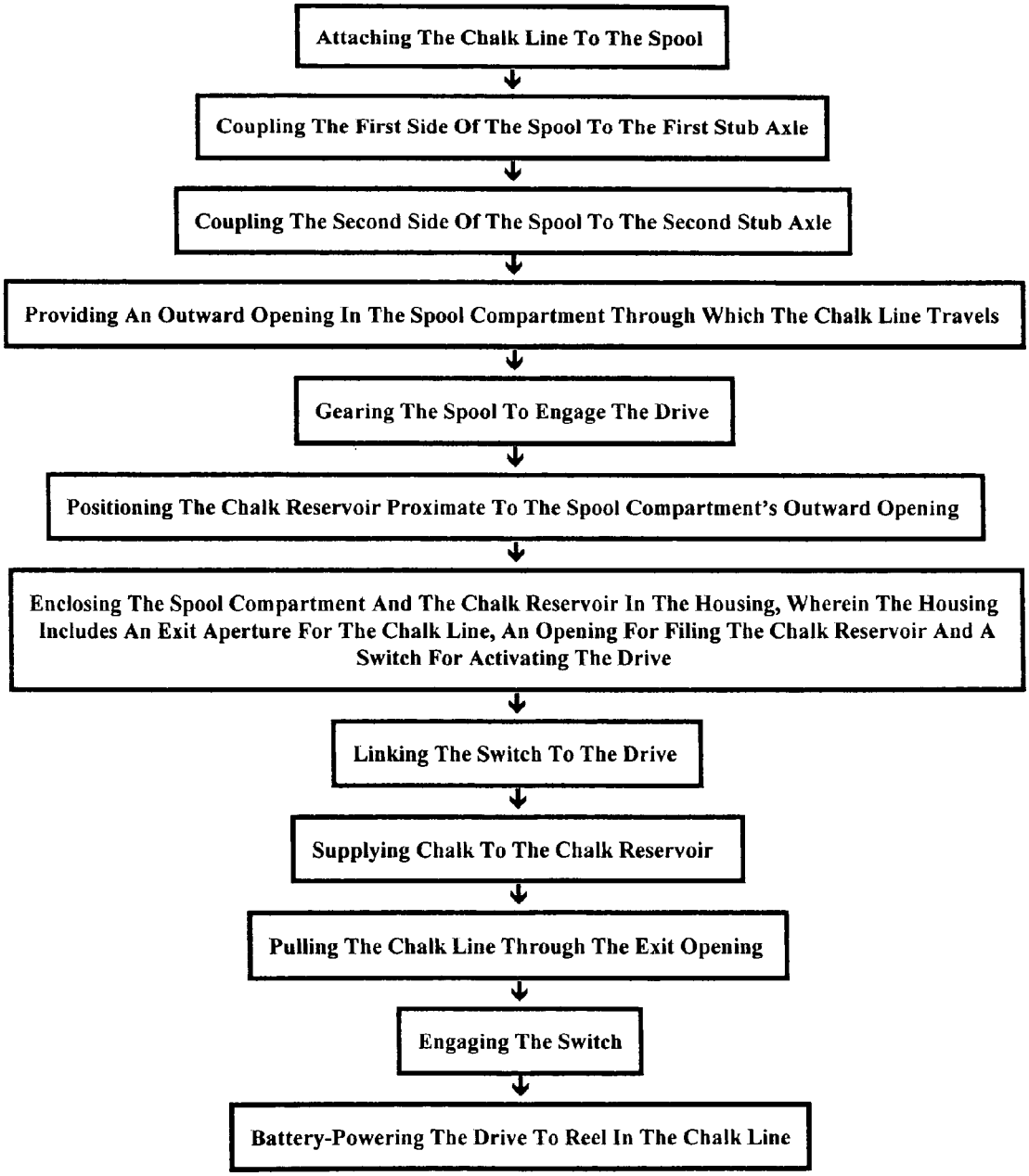
FIG. 10 is an illustration of the steps of an embodiment of the present method.
Figure 11:
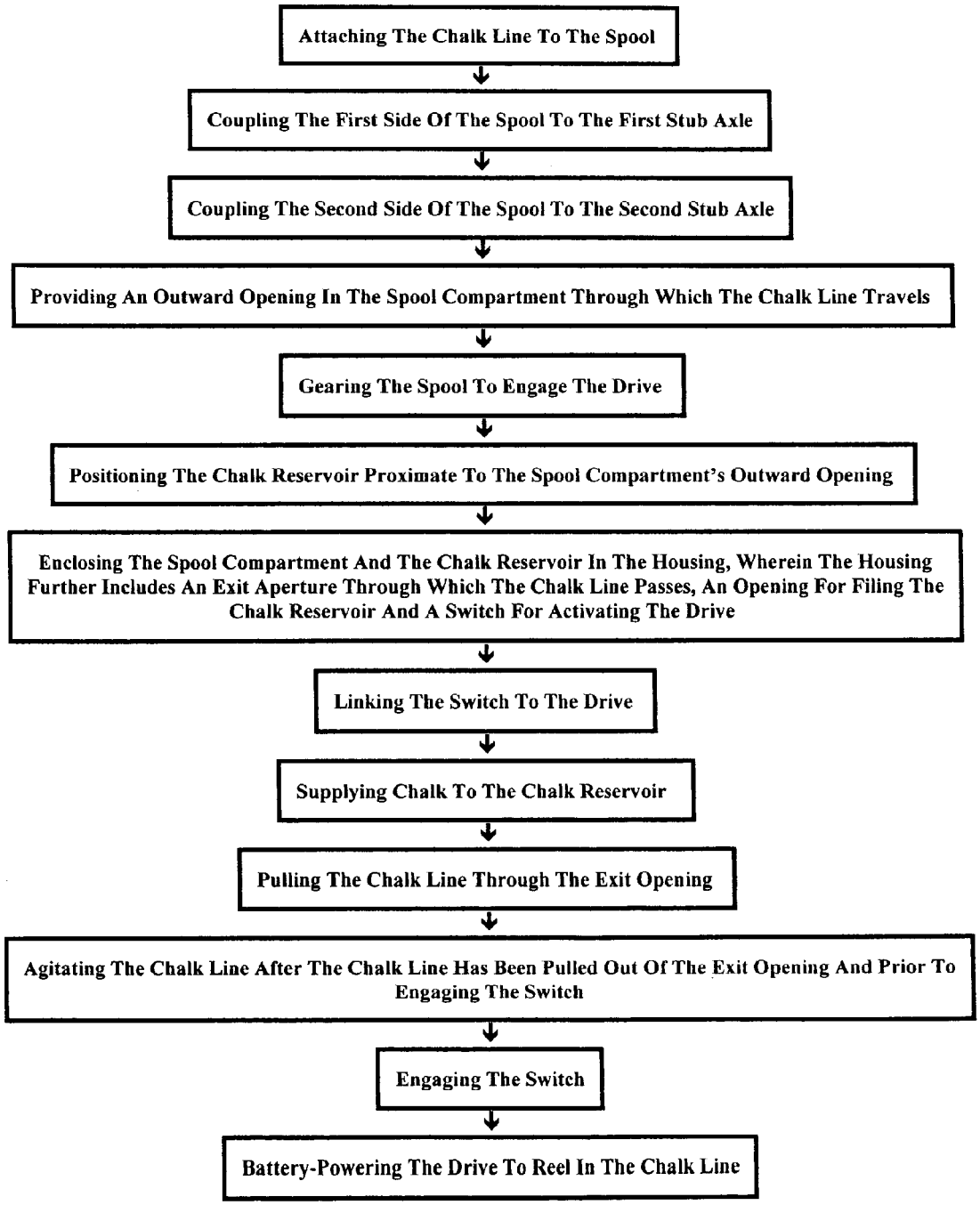
FIG. 11 is a depiction of the steps of another embodiment of the present invention.
Figure 12:
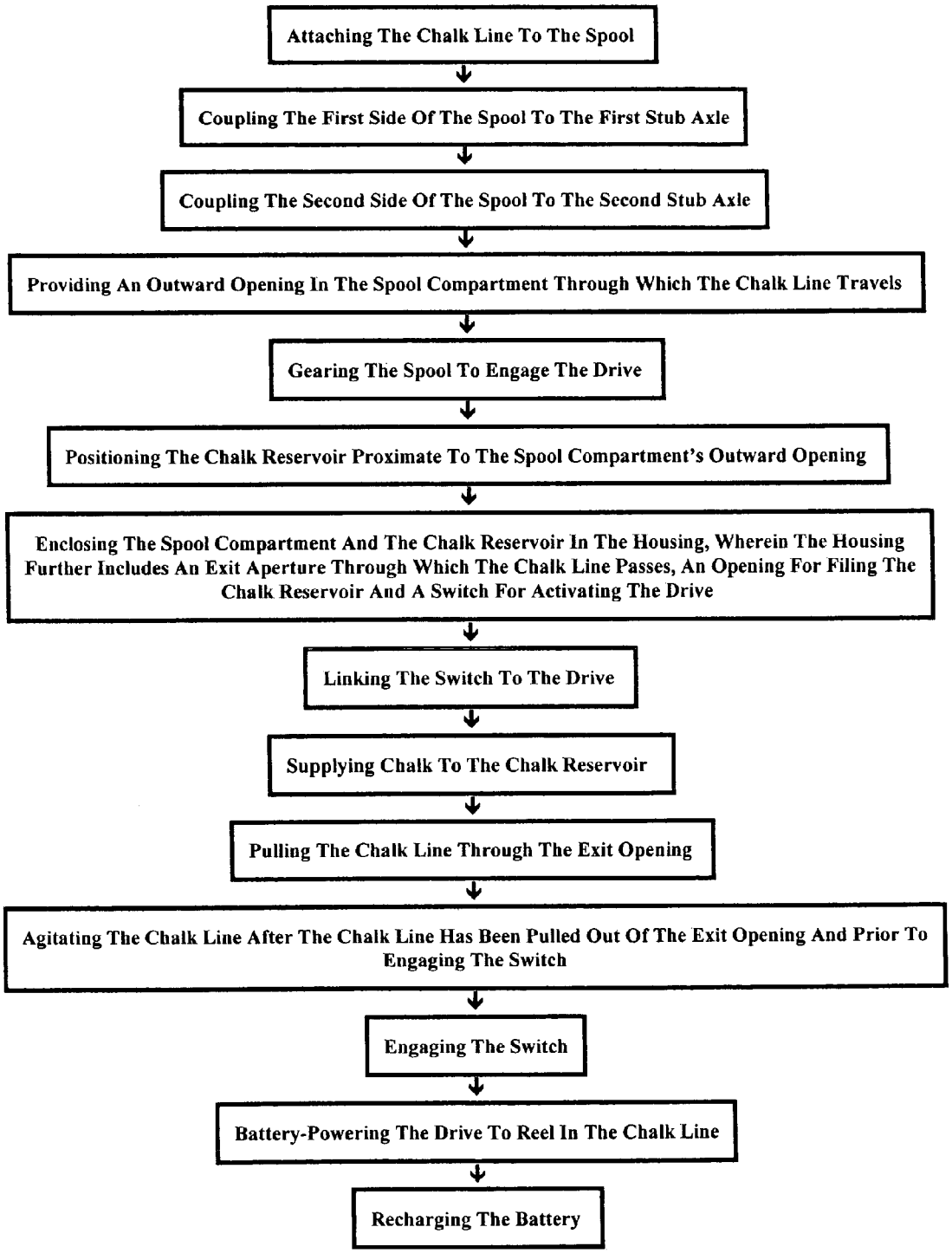
FIG. 12 is an exemplification of the steps of yet another embodiment of the current method.

Steps associated with the practice of the methods of present invention utilizing select structural elements enabled above are set forth in FIGS. 10–12. Having disclosed the invention as required by Title 35 of the United States Code, Applicant now prays respectfully that Letters Patent be granted for his invention in accordance with the scope of the claims appended hereto.

What is claimed is:

1. A motorized chalk line apparatus comprising:

a) a housing including an aperture having a portion of a chalk line extending therefrom;

b) a spool compartment within said housing further comprising:

i) a first stub axle extending inward from a first side of said spool compartment; and ii) a second stub axle extending inward from a second side of said spool compartment;

c) a chalk reservoir in proximity to said spool compartment communicating with said housing's aperture having said chalk line extending therefrom, wherein said chalk reservoir further comprises:

i) a first opening through which chalk is added to said chalk reservoir; and ii) a second opening communicating with said spool compartment;

d) a spool comprising:

i) a hollow extending from said first stub axle to said second stub axle; and ii) a driven gear;

e) a winding of said chalk line about said spool, wherein at least a portion of said chalk line extends through said second opening and said housing's aperture;

f) a drive for engaging said driven gear, wherein said drive rotates said spool to wind said chalk line about said spool;

g) an electrical motor communicating with said housing and said drive;

h) a battery communicating with said housing and linked to said electrical motor;

i) a switch communicating with said housing for activating said electrical motor; and j) a stop at an outward most portion of said chalk line.

2. The invention of claim 1 wherein said chalk reservoir further comprises a slide positioned about said first opening.

3. The invention of claim 2 wherein said stop further comprises an anchor.

4. The invention of claim 3 wherein said drive further comprises a drive gear for engaging said driven gear.

5. The invention of claim 4 wherein said switch is a contact switch.

6. A motorized chalk line apparatus comprising:

a) a housing including an aperture having a portion of a chalk line extending therefrom;

b) a spool compartment contained within said housing further comprising:

i) a first stub axle extending inward from a first side of said spool compartment; and ii) a second stub axle extending inward from a second side of said spool compartment and opposite said first stub axle;

c) a chalk reservoir joining said spool compartment and communicating with said housing's aperture having said chalk line extending therefrom, wherein said chalk reservoir further comprises:

i) a first opening through which chalk is added to said chalk reservoir; and ii) a common opening with said spool compartment;

d) a spool comprising:

i) a hollow extending from said first stub axle to said second stub axle; and ii) a driven gear;

e) a winding of said chalk line about said spool, wherein at least a portion of said chalk line extends through said common opening and said housing's aperture;

f) a drive for engaging said driven gear:

i) for rotating said spool to wind said chalk line about said spool, when said drive is energized; or ii) for allowing said chalk line to be pulled out of said housing's aperture, when said drive is deenergized;

g) an electrical motor communicating with said housing and said drive;

h) a battery communicating with said housing and linked to said electrical motor;

i) a switch communicating with said housing for actuating said electrical motor;

j) a stop at an outward most portion of said chalk line; and k) a recharging circuit communicating with said housing and linked to said battery for recharging said battery.

7. The invention of claim 6 wherein said stop further comprises an anchor.

8. The invention of claim 7 wherein said chalk reservoir further comprises a slide positioned about said first opening.

9. The invention of claim 8 wherein said drive further comprises a drive gear for engaging said driven gear.

10. The invention of claim 9 wherein said switch is a contact switch.

11. The invention of claim 10 further comprising a recharging base unit for said motorized chalk line apparatus.

12. The invention of claim 11 wherein said recharging base unit further comprises a junction fitted to reciprocate with a pair of exposed contacts of said recharging circuit.

* * * * *